United States Patent [19]
Hogan et al.
[11] 4,238,930
[45] Dec. 16, 1980

[54] ICE MAKER APPARATUS

[75] Inventors: Stephen J. Hogan, Boulder, Colo.; Roger L. Nyland, Lincoln Township, Berrien County, Mich.

[73] Assignee: Whirlpool Corporation, Benton Harbor, Mich.

[21] Appl. No.: 972,657

[22] Filed: Dec. 26, 1978

[51] Int. Cl.[3] ..... F25C 1/00
[52] U.S. Cl. ..... 62/138; 62/158; 62/233
[58] Field of Search.....62/74, 347, 348, 233, 62/158, 138, 353

[56] References Cited

U.S. PATENT DOCUMENTS

| | | | |
|---|---|---|---|
| B 451,396 | 4/1976 | Nurnberg | 62/158 X |
| 2,682,155 | 6/1954 | Ayres et al. | 62/348 X |
| 2,747,375 | 5/1956 | Pichler | 62/348 X |
| 2,959,026 | 11/1960 | Swanson | 62/138 |
| 3,039,278 | 6/1962 | Thompson | 62/140 |
| 3,246,210 | 4/1966 | Lorenz . | |
| 3,308,631 | 3/1967 | Kniffin | 62/353 X |
| 3,363,429 | 1/1968 | Wechsler | 62/140 |
| 3,540,227 | 11/1970 | Eyman, Jr et al. | 62/353 X |
| 3,613,388 | 10/1971 | Wendt | 62/130 |
| 3,859,813 | 1/1975 | Canter | 62/138 |

*Primary Examiner*—William E. Wayner
*Attorney, Agent, or Firm*—Wegner, Stellman, McCord, Wiles & Wood

[57] ABSTRACT

A slab-type ice maker apparatus wherein a slab of ice is formed on an inclined evaporator plate by the flowing of water over the upper surface of the refrigerated plate. A control is provided for sensing the temperature of the evaporator plate so as to determine when the thickness of the ice slab reaches a minimal preliminary thickness and continuing the ice slab formation for a preselected period of time subsequent to that determination to provide the completed final thickness slab. The thermally responsive sensing structure is mounted to the underside of the evaporator plate for improved sensing operation. The rate of flow of the water is reduced subsequent to the determination of the formation of the minimal thickness slab for improved efficiency in completing the formation of the final slab. Sensing structure is provided for determining the transfer of the ice slab to a slab dividing grid from the refrigerated plate. A subsequent ice making cycle is initiated a preselected period of time after termination of a previous ice making cycle notwithstanding a failure of the ice slab to move fully onto the dividing grid. The control requires a signal indicating the end of the ice forming cycle as well as a signal from the level sensing elements to effect a termination of the ice maker operation.

25 Claims, 6 Drawing Figures

121
11
10
13
22
23b
33
36
35
34
14
12
91
36
37
113
16
20
23b
15
28
33
17
60
19
36
114
31
30
18
24
32
94
29
95
42
32
25
TO DRAIN
27
26
23
23a

ICE MAKER APPARATUS

BACKGROUND OF THE INVENTION

1. Field of the Invention

This invention relates to ice makers and in particular to slab-type ice makers as may be utilized in commercial ice production.

2. Description of the Prior Art

One form of improved slab-type ice maker is shown in U.S. Pat. No. 2,682,155 of Russell W. Ayres et al, which patent is owned by the assignee hereof. As shown therein, a refrigerated evaporator plate is provided which is arranged to have water recirculated over the upper surface thereof to build up a slab of ice thereon. Upon completion of the buildup of the desired slab, the evaporator plate is suitably heated to disengage the slab and permit it to slide by gravity onto a network of resistance heating wires which melt through the ice, thereby dividing the slab into discrete ice bodies. The ice bodies are then collected in the subjacent storage bin from which they may be removed by the user in the conventional manner.

In the Donald F. Swanson U.S. Pat. No. 2,959,026 also owned by the assignee hereof, an improved means for determining the thickness of the ice slab formed on the evaporator plate is disclosed as comprising a sensing member supported above the evaporator plate so that when the ice builds up to the predetermined final desired thickness, a switch is operated to terminate the ice making cycle and initiate the heating cycle for releasing the slab from the plate. Upon release of the slab, the switch is restored to initiate a subsequent ice forming cycle.

Another patent owned by the assignee hereof is that of Oscar E. Wendt, U.S. Pat. No. 3,613,388. In the Wendt patent, a plurality of evaporator plates are provided for concurrently forming a plurality of ice slabs. The water is flowed seriatim over the respective plates and recirculated by suitable pump means. A control is provided for sensing the failure of a released slab to clear the lower end of the evaporator plate so as to at least partially obstruct the water flow.

A slab-type ice making apparatus is shown in U.S. Pat. No. 2,747,375 of Joseph R. Pichler as including means responsive to a drop in the pressure of the supply water to automatically discontinue operation of the ice maker. The means for sensing the thickness of the slab is disposed above the evaporator plate and is adjustably mounted so as to permit varying the thickness of the desired slab.

Stanley H. A. Thompson, in U.S. Pat. No. 3,039,278, shows a means for de-frosting refrigerating apparatus wherein the sensing of a frost buildup in the refrigerator is effected by means of thermistors connected in a Wheatstone bridge arrangement.

In U.S. Pat. No. 3,246,210, Jerome L. Lorenz shows an ice level control circuit utilizing thermistors installed in a storage bin. The thermistors are installed at different levels such that the lower thermistor may initiate an ice making cycle to bring the level of ice in the storage bin back to the level of the upper thermistor which effects a termination of the ice making cycle. The thermistors control an electromechanical relay for controlling operation of the compressor of the refrigeration means.

Reuben Wechsler et al, in U.S. Pat. No. 3,363,429, show a temperature control circuit for a refrigeration system utilizing thermistors in sensing a frost condition in the refrigerator.

Donald E. Neill, in U.S. Pat. No. 3,721,880, shows a refrigeration system compressor motor control utilizing a thermistor and thermostat having contacts providing suitable signals to transistor elements of the control which function as low threshold trip circuit locks.

In U.S. Pat. No. 3,859,813 of James A. Canter, an ice maker control circuit is disclosed utilizing a mercury thermostat switch responsive to a preselected buildup of the ice slab to stop operation of the water pump and initiate operation of the defrost cycle of the ice maker. The control further provides means for sensing the release of the ice slab under the ice cutting grid so as to effect initiation of a subsequent ice making cycle.

Ko Toya, in U.S. Pat. No. 3,977,851, shows an automatic electronic ice making control system for automatic ice making machines utilizing a thermistor and a differential amplifier including a variable resistor having the same characteristics as the thermistor for compensating the characteristics of the thermistor in accordance with atmospheric ambient temperature changes. Thus, the control is arranged to terminate production of ice independently of the temperature conditions and, thus, seasonal variations in the ambient surroundings of the ice maker.

In U.S. Pat. No. 3,988,903, Jimmy Milton Brewer et al show a dual acting defrost system for ice makers having a solid state switching control responsive to the water level sensing means at a discharge outlet of the evaporator.

SUMMARY OF THE INVENTION

The present invention comprehends a slab ice maker structure having an improved solid state and integrated circuit control utilizing digital logic for automatically controlling the ice making, ice harvesting, ice dividing, and ice storage functions thereof.

More specifically, the invention comprehends such an ice maker having an inclined refrigerated ice forming evaporator plate and means for flowing water in heat transfer association with the plate to build up a layer of ice thereon, sensing means for sensing the buildup of the ice layer to a first preselected initial thickness, and timer control means for causing continued flowing of the water for a preselected period of time subsequent to the sensing means sensing the preselected initial thickness on the plate thereby to increase the thickness of the ice layer to a second, desired final thickness.

The sensing means may comprise thermally responsive sensing means which, in the illustrated embodiment, are responsive to the temperature of the ice forming evaporator plate.

The minimal thickness slab may be approximately $\frac{3}{8}''$ thick.

The means for causing the continued flowing of the water for the preselected additional period of time may include manually adjustable means for varying the final slab thickness as desired.

The control means may be arranged to cause the rate of flow of the water over the evaporator plate to be decreased after the formation of the minimal thickness slab so as to provide improved efficiency in the forming of the final desired slab thickness.

The control means further includes means for preventing initiation of a subsequent operation of the ice making means until the released ice slab is effectively transferred from the ice forming means.

The means for controlling the rate of water flow may comprise means for varying the voltage applied to an electric motor driving a circulating pump effecting the desired circulation of the water over the evaporator plate. In the illustrated embodiment, the voltage decreasing means is arranged to decrease the voltage applied to the pump motor approximately 10 percent from the normal operating voltage thereof. The voltage dropping means may comprise a resistance connected selectively in series with the motor and switch means for selectively shorting out the resistance.

The means for sensing the formation of the minimal ice slab may comprise temperature responsive means arranged to sense the temperature of the evaporator plate subjacent the ice slab. The sensing means may include a stud welded to the bottom of the evaporator wall means and a sensing element mounted to the stud. The sensing element may comprise a thermistor.

The means for dividing the ice slab into discrete elements may comprise a resistance wire grid.

The ice maker may include sensing means for detecting the transfer of the formed slab to the dividing means and timer means operable after a preselected period of time for causing operation of the ice forming means notwithstanding the failure of the sensing means to detect the complete transfer of the previously formed slab.

In the illustrated embodiment, the timer effects reinitiation of the ice making cycle approximately ten minutes after the termination of the preceding ice making cycle notwithstanding the failure of the sensing means to detect the complete transfer of the previously formed slab from the ice making means.

In the illustrated embodiment, a plurality of ice forming means are provided with a corresponding plurality of dividing means. The sensing means is arranged to initiate a new cycle of ice making only after all of the sensing elements associated with the respective dividing means sense the completed delivery of the ice slabs thereto.

The means for sensing the transfer of the ice slab to the dividing means comprises means disposed above the dividing means and, in the illustrated embodiment, the sensing means comprises thermally responsive means.

In the illustrated embodiment, the control means is responsive to both a signal from the level sensing means of the storage bin and a signal from the transfer sensing means indicating the transfer of the ice slab from the ice forming means so as to prevent discontinuation of the ice forming means during the middle of an ice forming cycle.

The level sensing means of the storage bin comprises a plurality of spaced sensors for sensing the level of the collected ice therein at different positions. The sensing means is arranged to produce a full bin signal when any one of the plurality of sensors senses a level of ice at a preselected full level thereof. The additional capacity of the storage bin to store ice above the full level thereof is in a range from approximately the volume of ice produced in one cycle of operation of the ice forming means to the volume of ice produced in several cycles of operation.

In the illustrated embodiment, the level sensing means of the storage bin comprises thermally responsive elements, and more specifically, in the illustrated embodiment, comprises thermistor means.

The ice maker control of the present invention is extremely simple and economical of construction while yet providing the highly improved functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
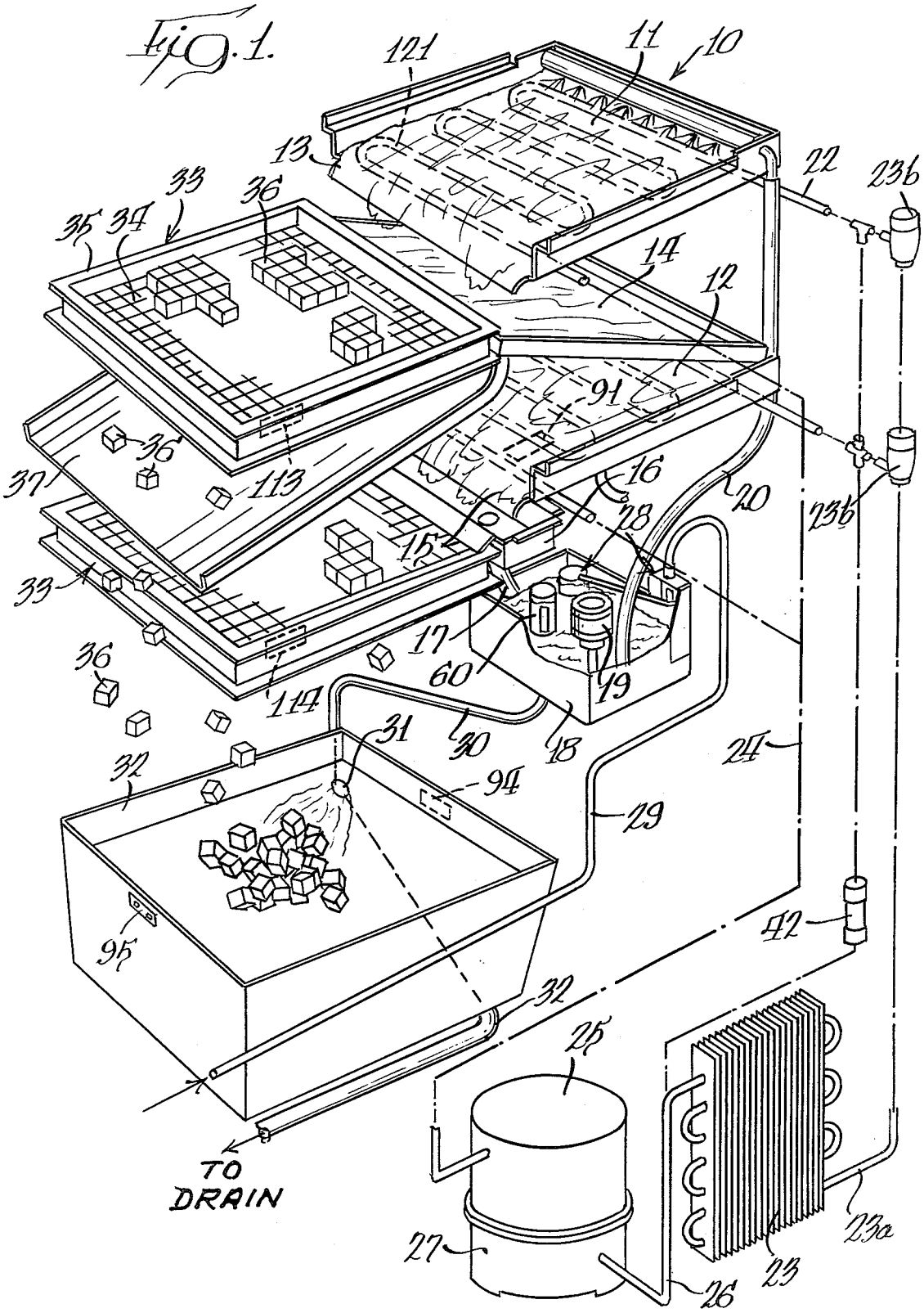
FIG. 1 is a perspective view with portions broken away illustrating the overall arrangement of the ice maker having an improved control means embodying the invention.

In the illustrative embodiment of the invention as disclosed in the drawing, an ice maker generally designated 10 is shown to comprise a multistage slab ice maker having a plurality of inclined evaporator plates defining illustratively a first upper slab forming plate 11 and a second lower slab forming plate 12. Water is flowed seriatim over the upper ice slab forming plate 11 and downwardly from a front edge portion 13 thereof onto a return trough 14 which is arranged to deliver the water onto the upper end of the lower evaporator plate 12 for flow thereover and thence downwardly over a front edge portion 15 thereof into a collecting trough 16 for return through a suitable duct 17 to a reservoir 18. A suitable pump 19 is provided in the reservoir for recirculating the water through a delivery duct 20 back to the upper end of the top evaporator plate 11. Thus, as the water is circulated over the upper surfaces of the evaporator plate, a slab of ice is built up on each of them as a result of the heat transfer from the water to the refrigerant flowed through the evaporator tubes, such as evaporator passageways or tubes 21, formed on the underneath surfaces of the evaporator plates. The refrigeration system is conventional and the refrigerant is delivered to the evaporator plates through delivery conduits 22 from a condenser 23 via a tube **23*a* and expansion valves 23*b*. The refrigerant is delivered from the evaporator tubes 21 through a suction line 24 to a conventional compressor 25, which, in turn, delivers the compressed refrigerant through a transfer line 26 to the condenser 23. A receiver, not shown, may be connected in the line connecting tube 23*a* and expansion valves 23*b***.

Compressor 25 includes an electric drive motor 27. Suitable control of the operation of the compressor drive motor 27 effects the desired operation and nonoperation of the ice forming means defined by the refrigerated evaporator plates.

The level of water in the reservoir 18 is controlled by a suitable float valve generally designated 28 which controls the delivery of water from a supply line 29 to the reservoir. A drain siphon 60 is provided leading to a drain line 30, which is also connected to a drain 31 in the storage, or collecting, bin 32 for draining the water to a suitable conventional drain.

The ice maker further includes ice slab dividing means generally designated 33 comprising a heated resistance wire grid 34 carried in a suitable frame 35 and disposed forwardly and below the evaporator plate so as to receive the slab of ice from the evaporator plate upon completion of the formation thereof. The slab of ice slides onto the grid wires 34 and is divided into discrete ice bodies, or elements, 36 as a result of the melting of the slab along the wire lines. The ice bodies, after falling through the heated grid means, are deflected by a guide 37 downwardly into the storage bin 32, as shown in FIG. 1. As further shown in FIG. 1, a second dividing means 33 is associated with the lower evaporator plate 12 for similarly delivering the divided discrete ice bodies 36 therefrom into the collecting bin.

As discussed above, the present invention comprehends an improved control for automatically controlling the operation of the ice maker to effect the desired ice formation therein suitable to maintain a preselected full level of the collecting bin substantially at all times. As discussed above, the ice maker is adapted for commercial use and, illustratively, may produce ice bodies 36 at a rate of approximately 450 pounds per 24 hour day under normal operating conditions. The collecting bin 32 is arranged to store up to approximately 356 pounds of ice bodies in the illustrated embodiment of the ice maker.

Figures 2, 5, 6:
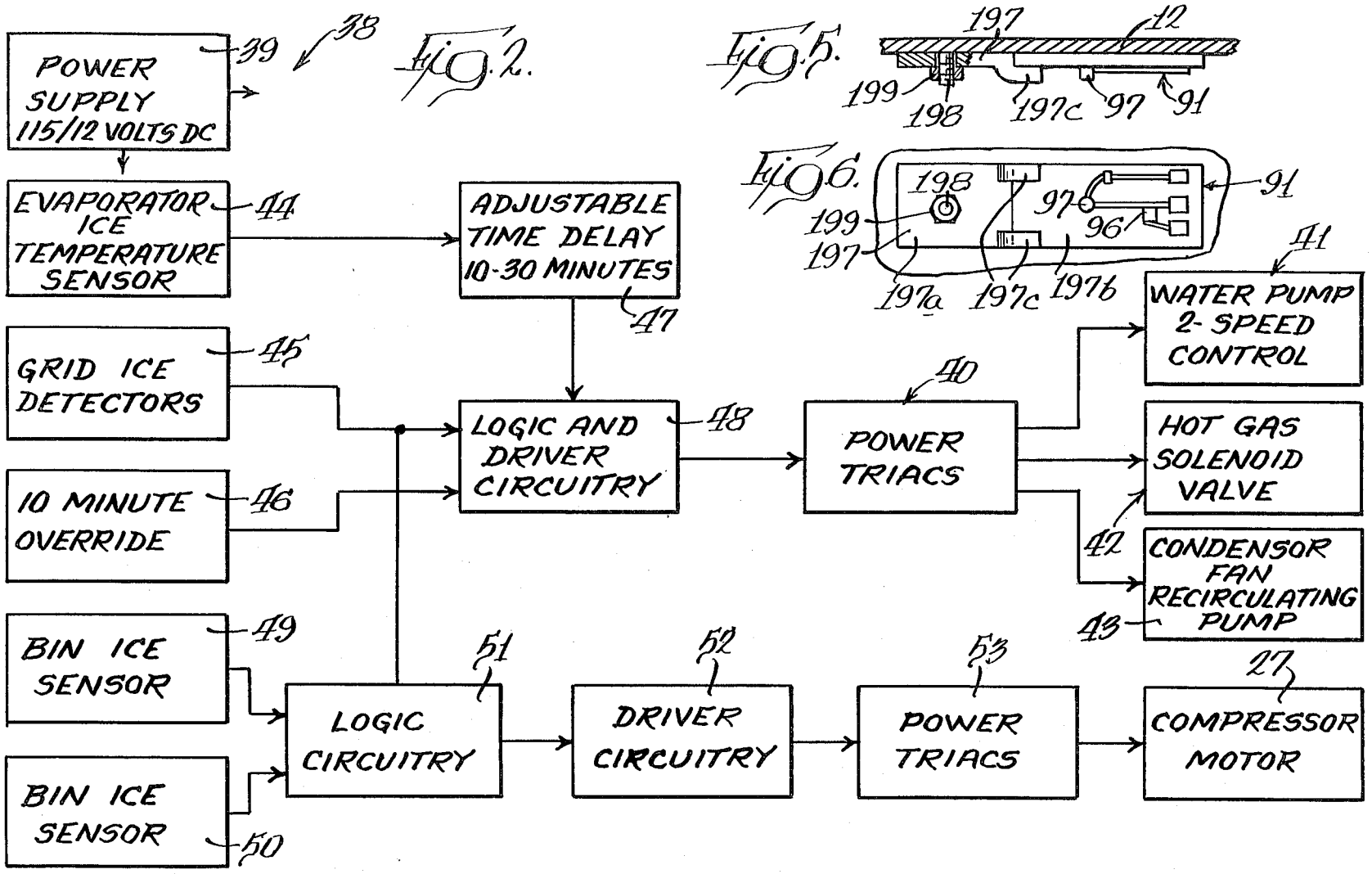
FIG. 2 is a block diagram of the control means.
FIG. 5 is a fragmentary side elevation of the slab sensing means.
FIG. 6 is a fragmentary bottom plan view thereof.

The improved control generally designated 38 is illustrated in FIG. 2. A power supply generally designated 39 is provided for converting the 115-volt supply current to 12-volt direct current for operating the control. As shown in FIG. 2, suitable power triacs generally designated 40 are provided for controlling a two-speed water pump control generally designated 41, a hot gas solenoid valve generally designated 42, and a condenser fan recirculating pump designated 43. The hot gas solenoid, when energized, opens the valve associated therewith, permitting circulation of hot gas through the evaporator plates facilitating rapid release of the ice slabs from the plates. Control of the triacs 40 is effected by means of an evaporator ice temperature sensor 44, grid ice detectors 45, and a 10-minute override control 46. The evaporator ice temperature sensor control is connected through an adjustable time delay device 47 to logic and driver circuitry 48 which, in turn, is connected to the power triacs 40. As shown, the grid ice detectors 45 and 10-minute override control 46 are connected through the circuitry 48 to the power triacs.

A pair of bin ice sensors 49 and 50 are connected through suitable logic circuitry 51 to the logic and driver circuitry 48 and to a second driver circuitry 52 to suitable power triacs 53 for controlling the compressor motor 27.

Figure 3:
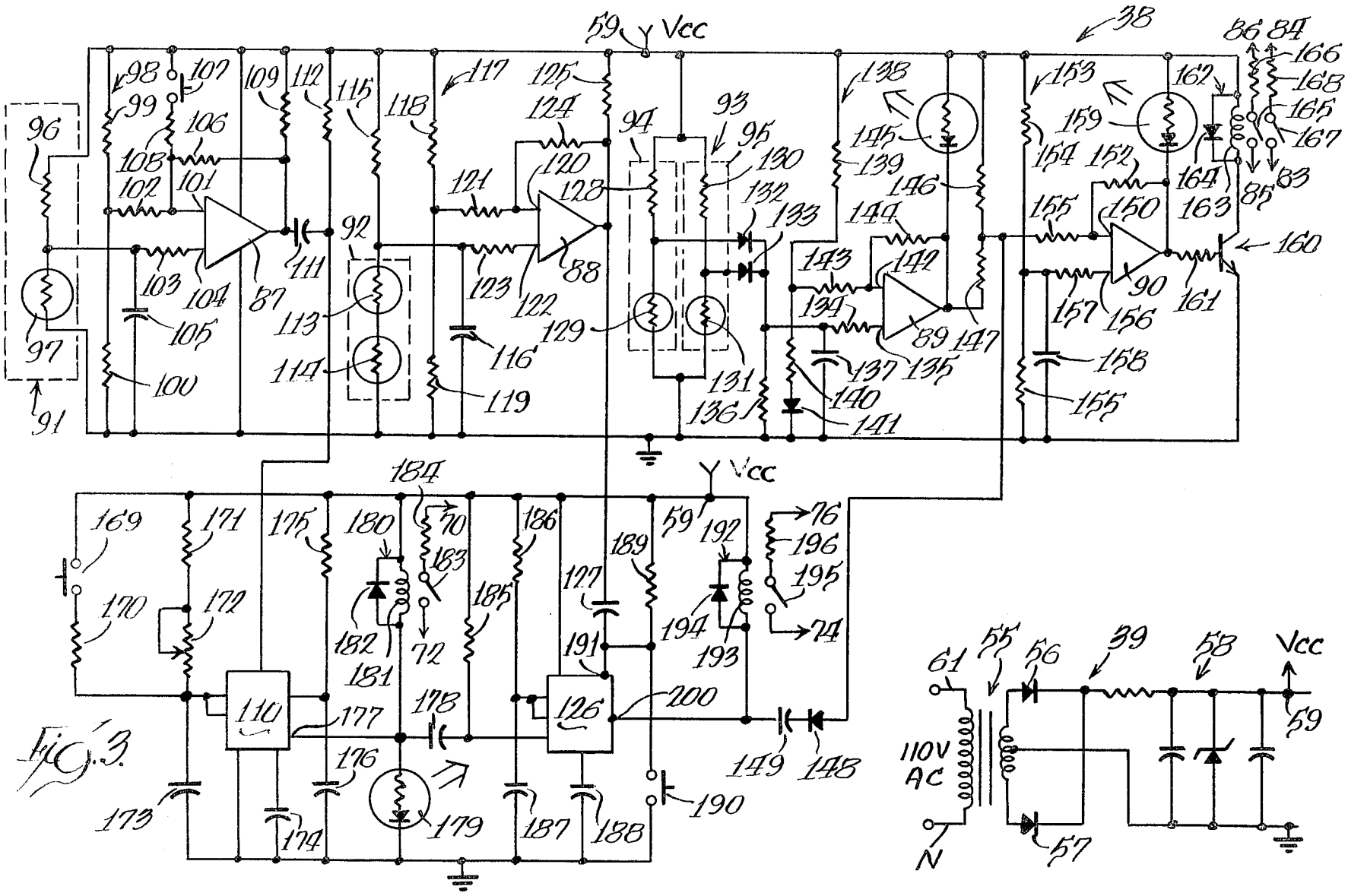
FIG. 3 is a schematic wiring diagram thereof.

Referring now to FIG. 3, the power supply 39 includes a voltage reducing transformer 55 connected through rectifiers 56 and 57 to a filter circuit generally designated 58 for providing a filtered 12-volt direct current output at terminal 59. Power supply 58 comprises a center tap full wave power supply providing proper power regulation in the control.

Figure 4:
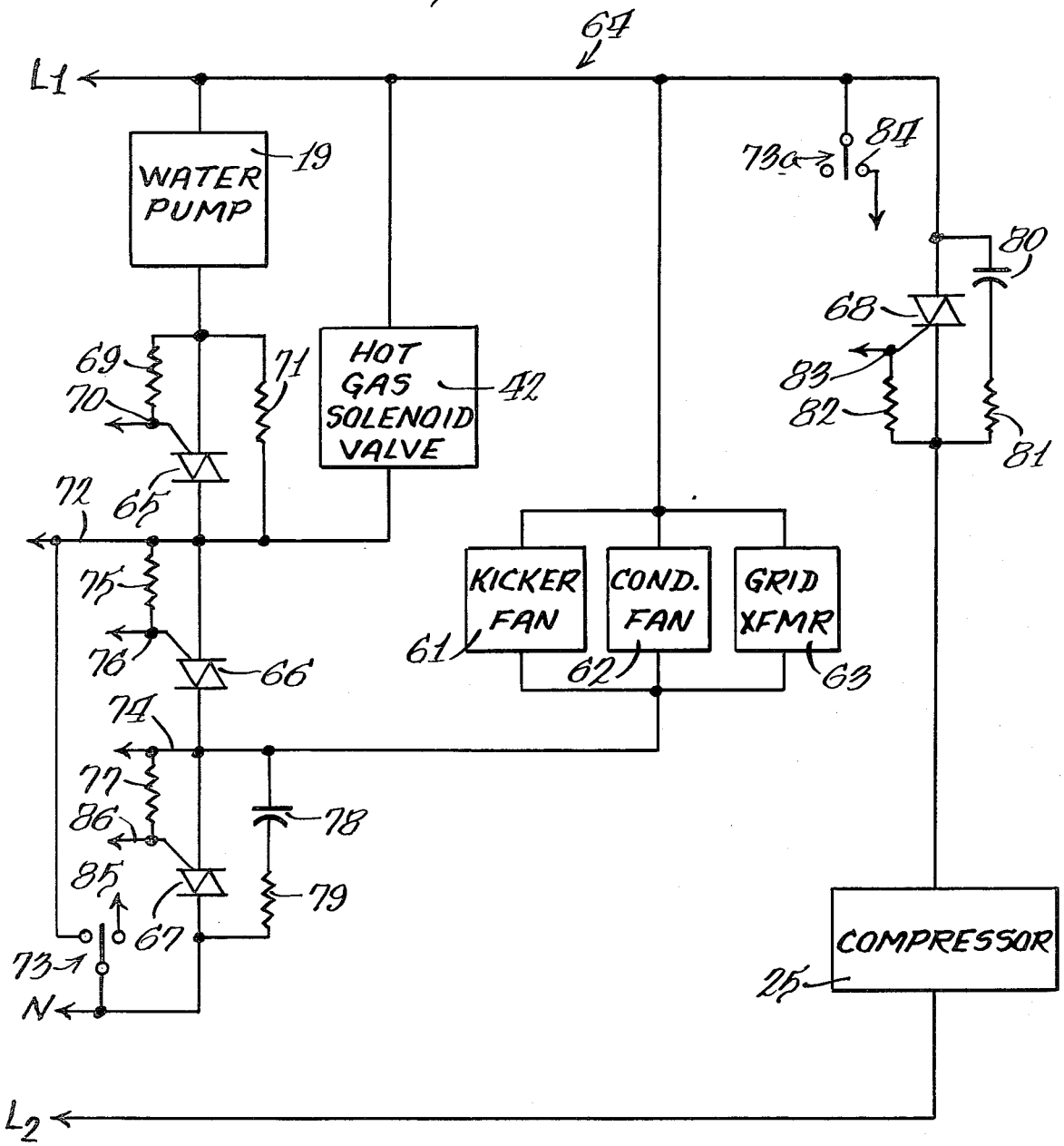
FIG. 4 is a schematic wiring diagram illustrating the switching arrangement of the ice maker operating means.

As shown in FIG. 4, the elements of the ice maker which are controlled by control 38 include the water pump 19 and compressor 25. Additionally, hot gas solenoid valve 42, a kicker fan 61, condenser fan 62, and grid transformer 63 are also provided to be controlled by the control 38. As shown in FIG. 4, the auxiliary circuit 64 in which these elements are connected further includes four power triacs 65, 66, 67, and 68.

More specifically, as seen in FIG. 4, water pump 19 is connected through a resistor 69 to a terminal 70 and through a resistor 71 to a lead 72 connected through a service switch 73 to the neutral power supply lead N. Triac 65 is connected between water pump 19 and lead 72 and hot gas solenoid valve 42 is connected between power supply lead L1 and lead 72.

Triac 66 is connected from lead 72 to a lead 74. A resistor 75 is connected from lead 72 to a terminal 76 connected to the triac 66.

Triac 67 is connected between lead 74 and power supply lead N and a resistor 77 is connected between power supply lead 74 and triac 67. A series connection of a capacitor 78 and a resistor 79 is connected between lead 74 and power supply lead N in parallel with triac 67.

A parallel connection of the kicker fan 61, condenser fan 62 and grid transformer 63 is connected between power supply lead L1 and lead 74.

Triac 68 is connected between power supply lead L1 and compressor 25, which, in turn, is connected to power supply lead L2. A series connection of a capacitor 80 and resistor 81 is connected in parallel with triac 68. A resistor 82 is connected between a terminal 83 and compressor 25, the triac 68 also being connected to terminal 83.

The service switch 73 includes a second switch portion **73*a* which is connected from power supply lead L1 to a terminal 84. As further shown in FIG. 4, the gate of the triac 67 connected to resistor 77 is connected to a terminal 86**.

As shown in FIG. 3, the respective terminal connections of FIG. 4, including connections 70, 72, 74, 76, 83, 84, 85 and 86, are connected to the respective different like-numbered portions of the control circuit 38. Referring specifically to FIG. 3, control circuit 38 includes four comparators 87, 88, 89 and 90. The comparators may comprise integrated circuit comparators mounted in a common package and which act as analog-digital converters by establishing a threshold voltage. The control includes three thermistor sensing devices, including evaporator plate sensing device 91, grid sensing device 92, and bin sensing device 93.

The evaporator plate sensing device 91 comprises a series connected resistor 96 and a thermistor 97, the output of which is connected to a voltage divider generally designated 98 comprising a resistor 99 and a resistor 100. The voltage divider 98 is connected to a positive terminal 101 of comparator 87 through an input hysteresis resistor 102. A second hysteresis resistor 103 is connected between the evaporator plate sensor 91 and the negative terminal 104 of comparator 87. A capacitor 105 is connected between thermistor 97 and resistor 103 to ground. A feedback hysteresis resistor 106 is connected between the output of comparator 87 and its positive terminal 101. The three hysteresis resistors 102, 103 and 106 prevent nuisance cycling and provide for positive switching.

A reset switch 107 in series with a resistor 108 is connected between terminal 59 and the positive terminal 101 of comparator 87. A load resistor 109 is connected between terminal 59 and the output of comparator 87. An integrated circuit solid state timer 110 is connected to the output of comparator 87 through a capacitor 111 and timer 110 is also connected to terminal 59 through a resistor 112.

The grid plate sensing device 92 comprises a thermistor 113 in series with thermistor 114, thus presenting an AND gate configuration. The grid plate sensor 92 is connected to terminal 59 through a series resistor 115. A capacitor 116 is also connected in parallel with the grid plate sensor 92.

A voltage divider generally designated 117, comprising a resistor 118 and a resistor 119, is connected to the positive terminal 120 of comparator 88 through resistor 121. The negative terminal 122 of comparator 88 is connected between grid plate sensor 92 and resistor 115 through an input resistor 123. A capacitor 116 is connected between the grid plate sensor 92 and resistor 115 to ground. A feedback hysteresis resistor 124 is connected between the output of comparator 88 and its positive terminal 120.

A load resistor 125 is connected between terminal 59 and the output of comparator 87 to a solid state timer 126 through a capacitor 127.

The bin level sensing device 93 comprises a pair of thermistor sensors 94 and 95, respectively, each in an OR gate configuration. Sensor 94 comprises a series connected resistor 128 and thermistor 129, and sensor 95 comprises a series connected resistor 130 and thermistor 131. The sensors 94 and 95 are connected through diodes 132 and 133, respectively, and through an input resistor 134 to a negative terminal 135 of a comparator 89 and also to ground through a parallel combination of a resistor 136 and a capacitor 137.

A voltage divider generally designated 138, comprising a resistor 139, a resistor 140, and a diode 141 in series, is connected to the positive terminal 142 of comparator 89 through an input resistor 143. A feedback hysteresis resistor 144 is connected between the output of comparator 89 and its positive terminal 142.

An indicator lamp 145, which is a light-emitting diode, and a series combination of resistors 146 and 147 are connected in parallel between the output of comparator 89 and terminal 59.

The output of comparator 89 is connected through resistor 147 and through a series combination of diode 148 and capacitor 149 to timer 126.

The positive terminal 150 of comparator 90 is connected between resistors 146 and 147 through an input resistor 155. A feedback hysteresis resistor 152 is connected between the output of comparator 90 and terminal 150.

A voltage divider generally designated 153, comprising a resistor 154 and a resistor 155, is connected to the negative terminal 156 of comparator 90 through an input resistor 157. A capacitor 158 is placed in parallel with resistor 155 between resistor 157 and ground.

An indicator lamp 159, which is a light-emitting diode, is connected between the output of comparator 90 and terminal 59.

The output of comparator 90 is also connected to the base of transistor 160 through resistor 161. The emitter of transistor 160 is connected to ground while the collector of transistor 160 is connected to a reed relay generally designated 162.

The reed relay 162 comprises a coil 163 and a diode 164, in parallel, which prevents latching. The reed relay switch 165 is connected to terminal 86 through resistor 166 and to terminal 85, as shown in FIG. 4. Similarly, relay switch 167 is connected to terminal 84 through resistor 168 and to terminal 83 of FIG. 4. The reed relay switches 165 and 167 operate to close when transistor 160 is energized, causing current to flow through the associated coil 163.

An "Ice Harvest" switch 169 and a series resistor 170 are connected in parallel with a resistor 171 and an ice thickness adjustment potentiometer 172 which are input to timer 110 and connected to ground through capacitor 173. The timer 110 is also connected to ground through capacitor 174. A series resistor 175 and a capacitor 176 are connected to timer 110 and between terminal 59 and ground.

The output of timer 110 from terminal 177 is connected to timer 126 through capacitor 178.

The output from the evaporator comparator 87 through capacitor 111 triggers timer 110. The output of timer 110 at terminal 177 goes high to 10 volts for a period of time which may be fixed by adjusting potentiometer 172. At the termination of timer 110's cycle, the output from terminal 177 goes to zero volts and this transition triggers timer 126 through capacitor 178.

The output of timer 110 from terminal 177 is also connected between an indicator lamp 179 and ground and a reed relay generally designated 180 and terminal 59.

Reed relay 180 comprises a coil 181 and a diode 182 connected in parallel. When current flows through coil 181, an associated relay switch 183 closes. Reed relay switch 183 is connected to terminal 70 through resistor 184 and to terminal 72, as shown in FIG. 4.

A resistor 185 is connected between terminal 59 and between timer 126 and capacitor 178. A series combination of a resistor 186 and capacitor 187 is connected between terminal 59 and ground with input to timer 126 connected between the resistor 186 and capacitor 187. Timer 126 is also connected to ground through a capacitor 188.

A series combination of a resistor 189 and a reset switch 190 is connected between terminal 59 and ground. This combination is also connected to the input of timer 126 between capacitor 127 and terminal 191.

The output of timer 126 is connected to a reed relay generally designated 192 comprising a parallel combination of a coil 193 and a diode 194. When current flows from timer 126 through coil 193, an associated switch 195 closes. The reed relay switch 195 is connected to terminal 76 through resistor 196 and to terminal 74, as shown in FIGS. 3 and 4. The output from comparator 89 is also connected to reed relay 192 through the series combination of diode 148 and capacitor 149.

The functioning of the control 38 provides an improved automatic control of the ice-forming operation. More specifically, the evaporator plate sensing device 91 (FIG. 3, at upper left corner) is mounted to the underside of the lower evaporator plate 12, as seen in FIGS. 5 and 6. To provide an improved sensing of the thickness of the ice slab, the thermistor 97 is mounted to a plate 197 which is secured to the underside of the evaporator plate by means of a stud 198 welded to the plate and a removable nut 199 threaded onto the end of the stud. Thus, the thermistor 97 is in good thermal transfer association with the evaporator plate while yet being disposed out of the area of ice formation. Plate 197 may comprise a metal portion **197*a* and an insulating portion 197*b* retained to portion 197*a* by means of solder and suitable tangs 197*c***.

Thus, when the temperature sensed by thermistor 97 reaches a preselected low temperature corresponding to a preselected minimal thickness of the ice slab, such as $\frac{3}{8}''$, the comparator is operated to trigger the timer 110, thereby starting a timing operation continuing the operation of the water pump 19 and the refrigeration cycle for a preselected further period of time, which can be adjusted by suitable adjustment of variable resistor 172. Thus, desired variable thickness of the ice slab may be readily obtained.

During the timed continuation of the ice-forming cycle, the rate of delivery of the water is decreased by suitably decreasing the output of the pump 19. This is effected by the opening of relay switch 183 by de-energization of relay coil 181, thereby opening the circuit between terminals 70 and 72 to turn off triac 65, as shown in FIG. 4, thus reducing the voltage of the water pump from normal line voltage, illustratively 115 volts, approximately 10% and in the illustrated embodiment approximately 18% to a reduced voltage of approximately 95 volts. It has been found that the reduced rate of water delivery provides an increase in the efficiency of the ice-making operation.

At the end of the adjusted preselected time, timer 110 effects a termination of the ice making cycle and an initiation of the harvest cycle when the output goes to zero volts. This transition triggers timer 126 which has a fixed time cycle, typically 10 minutes. While timer 126 is timing, its output at terminal 200 is high, thereby de-energizing relay coil 193 which causes relay switch 195 to open. When relay switch 195 is opened, the circuit between terminals 74 and 76 is opened to turn off triac 66, thus turning off water pump 19 and opening the hot gas solenoid valve 42 to release hot refrigerant gas, to heat each of the evaporator plates 11 and 12 which causes the ice slabs to be released. The ice slabs then slide off the plates and onto the grid wires 34.

Ice is sensed on the grid wires 34 by the thermistors 113 and 114 which drop below their established threshold temperature through contact of the ice slab on the grid. A pulse is then provided by thermistors 113 and 114 through comparator 88 to timer 126 at terminal 191. This signal terminates the harvest cycle by opening switch 195 which turns triac 66 (FIG. 4) on, thus turning water pump 19 on and closing the hot gas solenoid valve 42 for restart of the ice making cycle.

In the event either of the ice slabs does not completely slide off the associated evaporator plate and thus ice on either of the grids 34 remains undetected by thermistors 113 and 114, the ice making cycle is automatically restarted within an established period of time, typically 10 minutes.

A full bin is sensed by thermistor sensing devices 93 or 94 when the temperature of either drops below its adjusted threshold temperature. In this event, the output of comparator 89 goes low allowing comparator 90 to function. Biasing on the output of comparator 90 prevents it from turning off until an input pulse is received from timer 126, which occurs when both ice slabs fall onto the grid wires 34, or upon termination of the ice making cycle. Thus, shutdown of the compressor during the ice making cycle is prevented.

Upon receipt of the input pulse from timer 126, comparator 90 turns off with its output going to zero volts. Transistor 160 is thereby turned off preventing current flow in relay coil 163 which, in turn, opens the relay switches 165 and 167, thus turning off the drive for compressor triac 68 and load triac 67, shutting down the compressor. When both bin sensors 94 and 95 reach a temperature above their threshold value indicating a nonfull bin, the output of comparator 89 returns to 10 volts and forces comparator 90 back on. Current flows through transistor 160 and through relay coil 163 to close relay switches 165 and 167, thereby turning compressor triac 68 and load triac 67 back on for resumption of the ice making cycle.

The foregoing disclosure of specific embodiments is illustrative of the broad inventive concepts comprehended by the invention.

We claim:

1. In an ice maker having a refrigerated ice-forming plate and means for flowing water in heat transfer association with said plate to build up a layer of ice thereon, the improvement comprising:

sensing means for sensing the building of the ice layer to a first preselected initial thickness; and timer control means for changing the rate of ice layer formation while causing continued flowing of the water for a preselected period of time subsequent to said sensing means sensing said preselected initial thickness on said plate thereby to provide an improved controlled increase of the thickness of the ice layer to a second, desired, final thickness.

2. The ice maker of claim 1 wherein said sensing means comprises thermally responsive sensing means.

3. The ice maker of claim 1 wherein said sensing means comprises thermally responsive sensing means responsive to the temperature of said ice-forming plate.

4. The ice maker of claim 1 wherein said preselected initial thickness is approximately $\frac{3}{8}''$.

5. The ice maker of claim 1 wherein said control means comprises adjustable timer means whereby said final thickness may be selectively varied.

6. The ice maker of claim 1 wherein said control means concurrently terminates operation of the water flowing means and heats said plate to release the final thickness ice layer from the plate for harvesting of the ice at the end of said preselected period of time and prevents initiation of a subsequent operation of the water flowing means until the released ice layer is effectively transferred from the ice-forming means.

7. In an ice maker having ice-forming means operable to form a slab of ice, dividing means for dividing the slab into discrete ice bodies, means for transferring the formed slab of ice into the dividing means, and control means for terminating the operation of the ice-forming means upon completion of the forming of the ice slab and initiating a subsequent ice-forming operation to form a subsequent slab upon transfer of the first formed slab to the dividing means, the improvement comprising:

sensing means for detecting the transfer of the formed slab to the dividing means; and timer means operable after a preselected period of time for causing operation of the control means to initiate the subsequent ice formation operation in the event the first formed slab is not fully delivered to the dividing means so that the sensing means does not sense a transfer of the formed slab to cause said operation of the control means to initiate a subsequent ice-forming operation.

8. The ice maker of claim 7 wherein said timer means effects said initiation of the subsequent ice formation operation approximately 10 minutes after termination of the preceding ice-forming operation.

9. The ice maker of claim 7 wherein said ice-forming means includes means for concurrently forming at least one additional slab of ice and corresponding additional means for concurrently dividing each additional slab, said timer means being arranged to initiate the subsequent ice-forming operation in the event any one of the slabs is not transferred to its associated dividing means by the end of said predetermined period of time.

10. The ice maker of claim 7 wherein said control means includes thermally responsive means for sensing the thickness of the formed slab during an initial portion of the slab-forming operation and second timer means for continuing the ice-forming operation for a preselected additional period of time to complete the formation of the slab.

11. The ice maker of claim 7 wherein said sensing means comprises thermally responsive means disposed above the dividing means for sensing the presence of the transferred slab thereon.

12. In an ice maker having a refrigerated ice-forming plate and means for flowing water in heat transfer association with said plate to build up a layer of ice thereon, the improvement comprising:

means for causing the rate of flow of the water to be at a first preselected rate during an initial buildup of said ice layer to a preselected thickness; and means for causing the rate of flow of the water to be decreased as an incident of the ice layer reaching said preselected thickness and causing the decreased flow to continue for a preselected period of time to complete the ice buildup to a final thickness at an increased rate.

13. The ice maker of claim 12 wherein said water flowing means comprises an electric motor driven pump and said means for causing the rate of flow to be decreased comprises means for decreasing the voltage applied to the electric motor of the pump.

14. The ice maker of claim 12 wherein said water flowing means comprises an electric motor driven pump and said means for causing the rate of flow to be decreased comprises means for decreasing the voltage applied to the electric motor of the pump at least approximately 10 percent.

15. The ice maker of claim 12 wherein timer means are provided for causing the decreased flow rate to be maintained for a preselected period of time.

16. The ice maker of claim 12 wherein manually adjustable timer means are provided for causing the decreased flow rate to be maintained for an adjustable period of time to vary the final ice thickness as desired.

17. The ice maker of claim 12 wherein thermally responsive means are provided for effecting operation of the means for causing the decreased rate of flow.

18. In an ice maker having a refrigerated ice-forming plate means and means for flowing water in heat transfer association with said plate means to build up a layer of ice on a first surface portion thereof, the improvement comprising:

sensing means for sensing the temperature of said plate means at a second surface portion thereof opposite said first surface portion; and means for causing the thickness of the ice layer to be continued to be built up to a preselected thickness at a reduced rate as an incident of the sensing means sensing a preselected temperature corresponding to a preselected minimum thickness of the layer less than said final thickness.

19. The ice maker of claim 18 wherein said plate means comprises a generally inclined evaporator plate, said first surface portion comprises the upper surface thereof, and said second surface portion comprises the lower surface thereof.

20. The ice maker of claim 18 wherein said sensing means includes a stud welded to said plate means and a sensing element mounted to said stud.

21. The ice maker of claim 18 wherein said sensing means includes a stud welded to said plate means and a thermistor mounted to said stud.

22. The ice maker of claim 18 wherein said plate means comprises a generally inclined evaporator plate, said first surface portion comprises the upper surface thereof, and said second surface portion comprises the lower surface thereof, said sensing means being arranged to sense a minimum ice layer thickness of approximately $\frac{3}{8}''$.

23. In an ice maker having a refrigerated ice-forming plate and means for flowing water in heat transfer association with said plate to build up a layer of ice thereon, the improvement comprising:

sensing means for sensing the buildup of the ice layer to a first preselected initial thickness; and timer control means for causing continued flowing of the water for a preselected period of time subsequent to said sensing means sensing said preselected initial thickness on said plate thereby to increase the thickness of the ice layer to a second, desired, final thickness, said control means causing the water flowing means to decrease the rate of flow as an incident of the layer of ice reaching a preselected minimum thickness.

24. In an ice maker having a refrigerated ice-forming plate and means for flowing water in heat transfer association with said plate to build up a layer of ice thereon, the improvement comprising:

sensing means for sensing the buildup of the ice layer to a first preselected initial thickness; and timer control means for causing continued flowing of the water for a preselected period of time subsequent to said sensing means sensing said preselected initial thickness on said plate thereby to increase the thickness of the ice layer to a second, desired, final thickness, said control means causing the water flowing means to decrease the rate of flow during said preselected period of time.

25. In an ice maker having a refrigerated ice-forming plate and means for flowing water in heat transfer association with said plate to build up a layer of ice thereon, the improvement comprising:

means for causing the rate of flow of the water to be at a first preselected rate during an initial buildup of said ice layer; and means for causing the rate of flow of the water to be subsequently decreased to complete the ice buildup to a final thickness at an increased rate, said water flowing means comprising an electric motor driven pump and said means for causing the rate of flow to be decreased comprising a resistance in series with the electric motor of the pump and means for selectively shorting out said resistance for allowing the motor to run at normal speed and for permitting the resistance to be connected in electrical series with the motor to drop the voltage thereto a preselected amount.

* * * * *